United States Patent [19]

Metzger et al.

[11] 3,964,694

[45] June 22, 1976

[54] AERIAL ACOUSTIC TARGET SEEKER

[75] Inventors: Arthur C. Metzger, Wayland, Mass.; William Hadden, New Providence, N.J.

[73] Assignee: The United States of America as represented by the Secretary of the Army, Washington, D.C.

[22] Filed: Feb. 14, 1967

[21] Appl. No.: 617,763

[52] U.S. Cl. ..... 244/3.15; 244/3.21

[51] Int. Cl.[2] ..... F42B 15/02

[58] Field of Search ..... 244/3.15, 3.21; 102/8, 102/19.2

[56] References Cited

UNITED STATES PATENTS

| | | | |
|---|---|---|---|
| 2,109,475 | 3/1938 | Fanning | 244/3.15 UX |
| 2,330,205 | 9/1943 | Cox | 102/8 UX |
| 2,644,397 | 7/1953 | Katz | 244/3.15 |
| 3,027,859 | 4/1962 | Wiebusch | 244/3.15 X |
| 3,031,644 | 4/1962 | Hisserich et al. | 102/19.2 X |
| 3,072,365 | 1/1963 | Linscott et al. | 244/3.21 X |
| 3,104,081 | 9/1963 | Arnett | 244/3.21 |
| 3,304,864 | 2/1967 | Thomanek | 102/19.2 |

*Primary Examiner*—Verlin R. Pendegrass
*Attorney, Agent, or Firm*—Nathan Edelberg; Robert P. Gibson; A. Victor Erkkila

[57] ABSTRACT

An acoustic destructive aerial target seeker having recognition-guidance circuitry which is adapted to detect and recognize the characteristic sound emitted from an armored vehicle and to launch and direct the system toward destructive impact with the target.

1 Claim, 9 Drawing Figures

INVENTOR.
ARTHUR C. METZGER
WILLIAM HADDEN
BY Harry M. Saragovitz
Edward J. Kelly, Herbert Berl
& S. Dubroff.
ATTORNEYS:

INVENTOR.
ARTHUR C. METZGER
WILLIAM HADDEN
BY Harry M. Saragovitz
Edward J. Kelly, Herbert Berl
& S. Dubroff
ATTORNEYS.

INVENTOR.
ARTHUR C. METZGER
WILLIAM HADDEN
BY Harry M. Saragovitz
Edward J. Kelly, Herbert Berl
& S. Dubroff
ATTORNEYS:

INVENTOR.
ARTHUR C. METZGER
WILLIAM HADDEN
BY Harry M. Saragovitz
Edward J. Kelly, Herbert Berl
& S. Dubroff
ATTORNEYS:

INVENTOR.
ARTHUR C. METZGER
WILLIAM HADDEN
BY Harry M. Saragovitz
Edward J. Kelly, Herbert Berl
& S. Dubroff ATTORNEYS:

AERIAL ACOUSTIC TARGET SEEKER

This invention relates to an area denial weapon and particularly, to an aerial detection-guidance system which seeks and strikes a target by recognizing and following the sound emitted by the target.

One of the present objectives in developing area denial weaponry is the need for a simple and reliable short range guidance system for use, in particular, as a mine barrier system. Such a system would be invaluable in stopping tanks, personnel carriers, or other slow moving vehicles of the armored type that emit different individual characteristic low frequency sounds in operation.

The techniques now in effect for use against such vehicles include the use of mines, unguided rockets or projectiles, and guided missiles.

Mines have a very limited sphere of influence in that it is essential that the target to be destroyed or otherwise come within contact or within a few feet of the mine for it to be effective. For a mine to be employed as a barrier, large numbers, sometimes thousands or more, are needed to provide a statistical impregnable defense line for stopping single or multiple vehicles.

The unguided rockets or projectiles now in use are primarily line of sight devices, and have a relatively low probability of a single round hit. Consequently, as with mines, the cost of immobilizing or destroying a single vehicle can be very high.

The guided missiles that presently exist employ guidance propulsion systems that are ineffective over short ranges, that is, 100-200 meters, principally because of their inherent high speeds and short reaction times. Active guidance systems are easily counter measured and passive guidance systems are excessively influenced by environment. They are also complex costly systems, and as such, not suitable for use as mine barriers.

In considering the problem of creating an effective low density mine barrier system, it is desirable to effect a major reduction in the tremendous logistic burden, not only in the number of mine barriers involved but also in the cost of maintaining such a system; to extend the area of influence to several hundred meters, and have the system counter measure resistant, light weight, small, low cost, reliable, all weather operable, controllable and unmanned.

Accordingly, a principle object of the present invention is to overcome the above mentioned disadvantages of the prior art.

Another object of the invention is to provide an acoustic destructive aerial target-seeker not particularly affected over its short range of operation by acoustic signal attenuation.

A further object of the invention is to provide a passive detection-guidance system for use as an area denial weapon.

A still further object of the invention is to provide a target seeking flight vehicle effective as a low density mine barrier system.

Other objects of the invention will in part be obvious and in part appear hereinafter in the following disclosure and in the accompanying drawings.

In the drawings accompanying and forming part of this specification,

Figure 1:
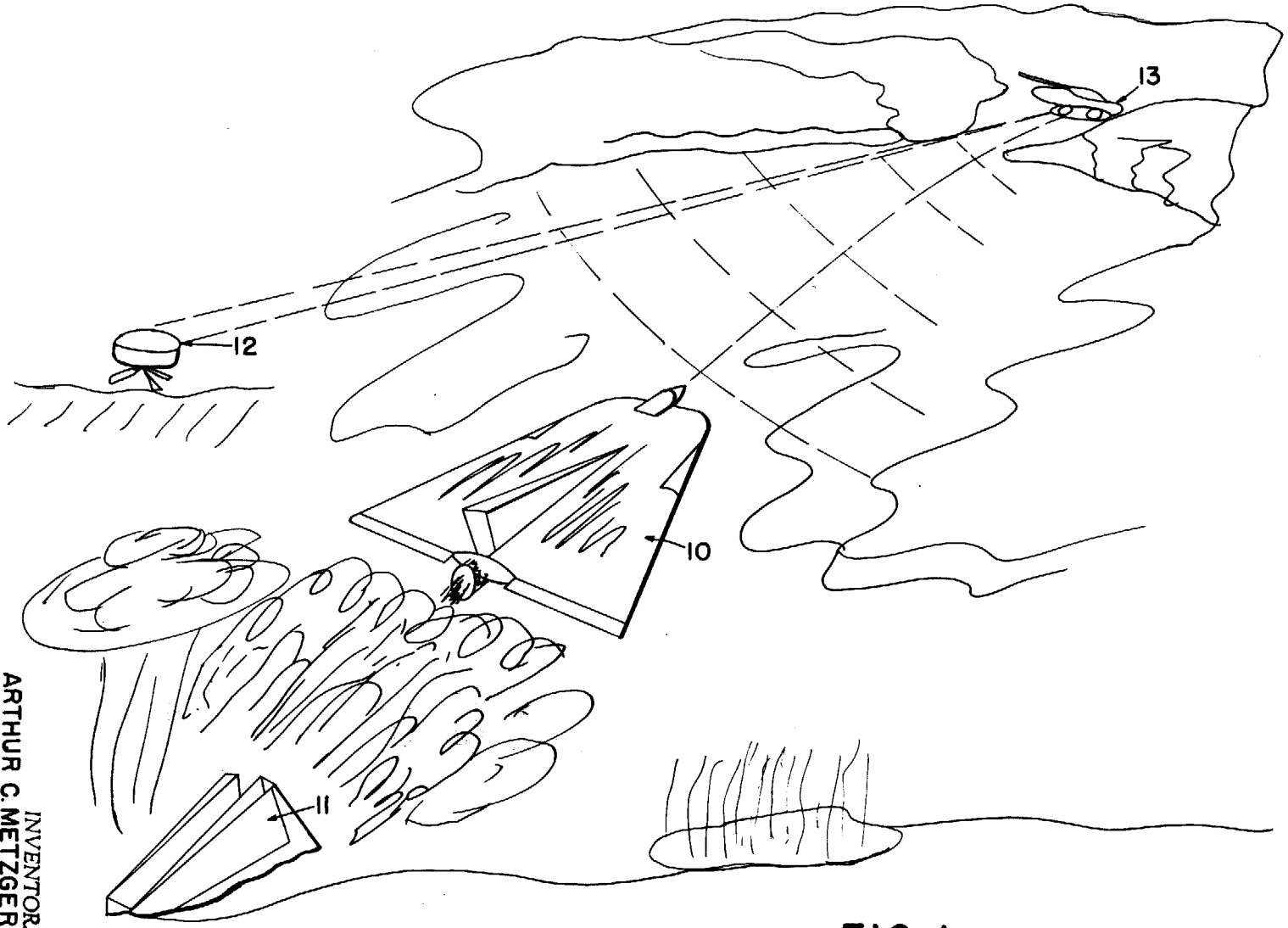
FIG. 1 depicts the deployment of a flight vehicle used as an area denial weapon in accordance with the present invention.

Referring to the drawings wherein like reference numerals apply to like parts throughout, and specifically to FIG. 1, wherein a flight vehicle 10 is launched from a preset launch pedestal 11 at a command from an adjacent control center 12. The flight vehicle will automatically seek the target sound source from its in flight position to destroy or immobilize the target vehicle 13. The weapon may be employed individually or in multiples as a mine barrier system, each flight vehicle being launched from its own pedestal and capable of being commanded from a single control center. The control center can recognize, locate and command a single or multiple and repetitive launchings at an intruding target. The flight vehicle is pictured as having a flying wing airframe structure, but it is to be understood that the device is not limited to this particular shape, which is given merely for illustrative purposes.

The launch pedestal 11 is an inclined rack which permits emplacement of the flight vehicle on the surface of the ground and permits pointing of the minedrone into a pre-selected horizontal quadrant for launching. The area to be covered could be from a few degrees to approximately 45° depending on tactics and numbers of units involved.

In addition to its holding and aiming function, the pedestal would receive the command to launch and could contain an electrical source (not shown) for ignition of a propellant means which could be carried by the flight vehicle.

Figure 3:
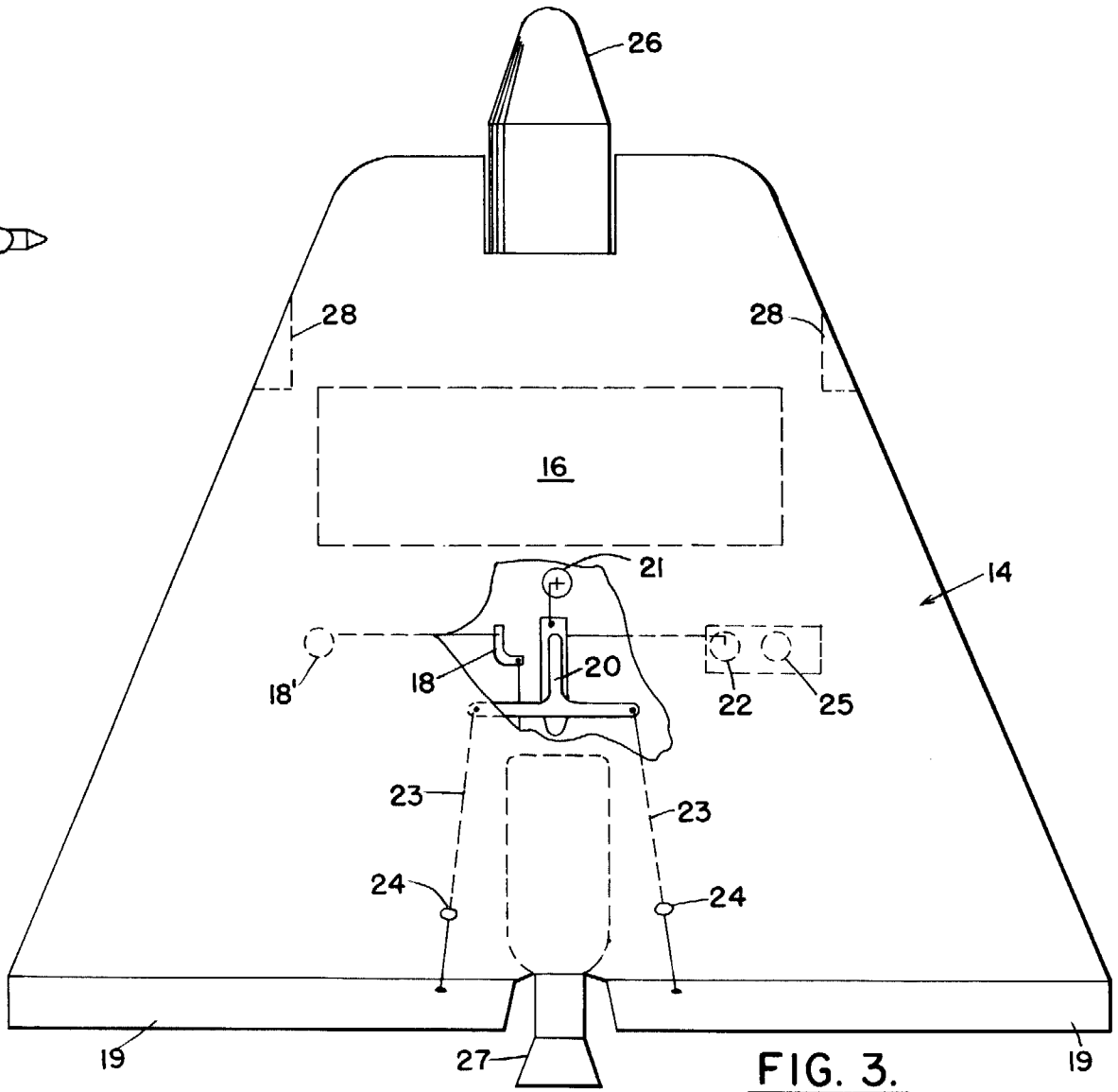
FIG. 3 depicts a partial sectional top view of the same embodiment.
Figure 2:
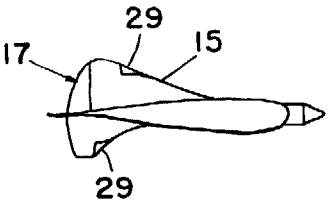
FIG. 2 depicts a side view of a specific embodiment of the inventive device.

FIGS. 2 and 3 show the flying wing shaped structure 14 with a vertical fin 15. Construction can be of a high impact strength molded plastic such as fiberglass or polystyrene, glass filled. The lateral cross section is preferably an airfoil shape which is deep enough to house the various electrical guidance components 16.

The in-flight mode would be, by its design, one of inherent stability. Desired deflection from the stable condition would be achieved by the movement of a combination of flight directing control surfaces.

The flight-directing vertical fin 15 stabilizes the flight pattern in a horizontal plane and extends above and below the main body 14. Change in lateral direction in flight is caused by a hinged rudder 17 part of the fin 15. An "L" shaped bellcrank 18 transmits lateral control motion to the rudder 17. A yaw servo 18' controls the movement of the bellcrank 18.

Control in a vertical plane and roll control is achieved by elevons 19 which are two hinged trailing edge pieces, and are part of the wing elements. The control linkage to these surfaces is such that up and down vertical extremes can be obtained for vertical control along with an independent unequal up and down motion for roll control. This is accomplished with the moving "T" shaped bellcrank 20 which slides forwardly and rearwardly as commanded by the pitch servo 21, as well as pivoting in a horizontal direction as commanded by the roll servo 22. The control linkages shown are push-rods 23 that extend through openings 24 in the airframe to a horn (not shown) on each elevon 19.

A single gyroscope 25 is connected through servo 22 to actuate the elevons 19 to control roll. This would not affect the vertical control which functions independently. The single gyroscope 25 maintains the flight vehicle in a stable reference condition of flight. A hook (not shown) provided on the launch pedestal 11 (FIG. 1) would allow anchoring of a light wire extending from the gyroscope 25 so that launching tension on the wire would initiate the gyroscope. A derivation signal in roll would cause a resultant signal to be sent to the roll servo 22 for corrective action.

The roll servo 22, as well as the yaw servo 18' and the pitch servo 21, are geared down D.C. motors. The servos 18' and 21 operate off the balanced or unbalanced reference voltage from the electrical guidance components 16. The direction and magnitude of unbalance would determine the rotation direction and amount of revolution of the servo motors, and thus through the linkages result in flight attitude changes in lateral and vertical directions.

It is to be understood that the automatic roll control is not limited to a gyroscope, which is merely given for illustrative purposes, but a mercury pool or a dash-pot mechanism could possibly be a simpler means of achieving roll stability.

The explosive charge 26, carried by the flight vehicle can be a standard high explosive antitank (HEAT) round head intended for use against armored targets, or a light antitank (LAW) head could be used. Since the launching technique and in-flight forces of the flight vehicle are related to that of a standard bazooka projectile, only minor modifications would have to be made to the safing and arming techniques of the previous mentioned charges. The head and fuze can be coupled to the airframe with a threaded adapter or coupling clamp (not shown) or by any other preferred technique.

The propellant means 27 is preferably a two-stage rocket motor with an electrical igniter. The reason for this preference will be explained later in conjunction with FIG. 8.

The acoustic guidance system consists of electrical guidance components 16 and two pairs of directional sound receiving and translating elements, 28 and 29. One pair, 28, is positioned to lie in spaced laterally disposed relation on the wing elements 14 and provide yaw information to the guidance components 16. The other pair, 29, is positioned to stand in spaced vertically disposed relation on the fin element 15 and provide pitch information to the guidance components 16. The guidance components 16 include individual electrical control channels connected from the vertically and laterally disposed pairs of sound transducers to said pitch and yaw servos respectively which initiate the movement of the flight directing control surfaces to maintain the vehicle on course to the target. More than two pairs of sound transducers may be employed, which are only given by way of a preferred example, to increase the sensitivity or the range of the vehicle to target sounds.

The concept of an acoustic guidance system is dependent upon the formula $$\lambda = v/f,$$

where $\lambda$ is the wave length of the desired acoustic energy; $v$ is its velocity which is equal to 1087 feet per second at 0°C in air; and $f$ is the frequency of the desired acoustic energy. The frequency of interest is in the low frequency audible spectrum; from about 100 to 1000 cps, since predominantly all the acoustic energy of vehicles, that is the characteristic sound of vehicles in operation, of the armored type, is contained in this portion of the frequency spectrum. Therefore $$\lambda = 1087/(100<f<1000),$$

and $$1.087 < \lambda < 10.87 \text{ feet};$$

In order that a pair of transducers spaced a certain distance apart cannot simultaneously hear an acoustic signal more than $\lambda/2$ apart, it is necessary that the travel distance from the sound source be no greater than the half wave length at any orientation. Therefore the transducers may be placed, according to the frequency of the sound being emitted from the target, at a distance varying from 0.54 to 5.4 feet, which allows great latitude in the design of the flight vehicle.

Figure 4:
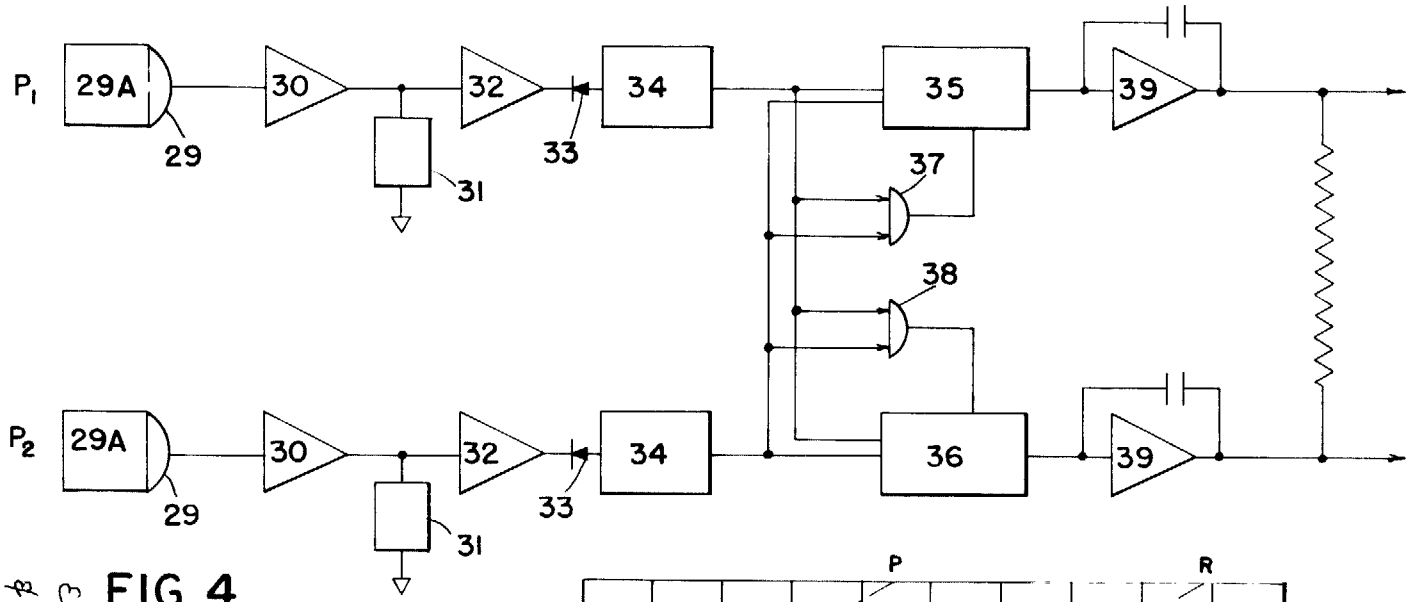
FIG. 4 illustrates, in block diagram form, a specific embodiment of an electrical guidance circuit employed in the inventive device.
Figure 5:
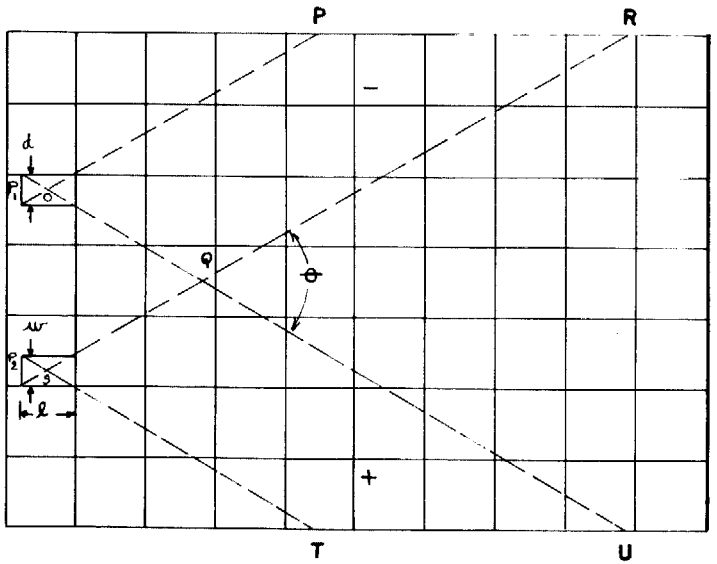
FIG. 5 illustrates the directionality of electrical sound transducers employed with the circuit of FIG. 4.

FIG. 4 is a block diagram of a specific embodiment of the electrical guidance components 16, showing an acoustic-phase guidance system. The elements 29A 28 are short hoods ($d/L<3$) used to screen transducers 29 and to provide a limited degree of directionality to them, as can be seen in FIG. 5. In FIG. 5, transducer system $P_1$ can monitor the area enclosed by POU, transducer system $P_2$ monitors the area enclosed by RST, and both $P_1$ and $P_2$ monitor the area enclosed by RQU. As will be shown, an acoustic signal in the POQR area will correspond to a maximum negative output voltage to the servo (pitch or yaw). Likewise an acoustic signal in the TSQU area will correspond to a maximum positive output voltage to the servo (pitch or yaw). An acoustic signal in the RQU area will be a positive or negative output voltage to the servo between the maximum and zero values, depending on the specific position of the signal.

Referring again to FIG. 4, the transducers 29 are used to receive the acoustical signal emitted by the vehicle to be stopped or destroyed. The signal is preamplified at 30, and the filters 31 provide a narrow bandpass output signal. The filters are easily interchangeable module units, and depending on the characteristic signal emitted by the target to be defeated, can be chosen so as to limit the signal passed to the frequency range of the characteristic signal. In other words, the band width and frequency selected is dependent on the type of target to be tracked.

The phase difference between the signal from the two microphones is some fraction of a half wave length, depending on the position of the target in relationship to the transducers. These signals are amplified a second time at 32 and half-wave rectified by diodes 33. Clipper circuits 34 square off the signals in order to establish a minimum rise time and trigger delay for the following normally open switching circuits, each of which include a bistable switch, 35 and 36, and an AND gate, 37 and 38. The bistable switch 35 provides a D.C. output when closed. The switch is closed when the clipper circuit 34 and the AND gate 37 have received a signal from $P_1$ and not from $P_2$. Under the same conditions, bistable the switch 36 will not provide a D. C. output because it is open, and must receive a signal from $P_2$ and not from $P_1$ to be closed. If $P_2$ was to receive a signal before $P_1$ then bistable switch 35 is opened by clipper 34. The on time of the switch represents the phase difference between the two transducer inputs and is representative of the angular error of the orientation of the microphones to the target. If the transducers were oriented so that the target noise was directly in front of the transducer system, the phase difference would be zero, and hence neither bistable switch would be closed to allow a signal to pass. The output of the bistable switches, 35 or 36, is used to turn on an associated signal integrator circuit 39, which provides an output voltage of a fixed polarity to drive the steering yaw or pitch servo (18' and 21 respectively, FIG. 3). The polarity of the system is reversed when the other integrator circuit is turned on.

Figure 6:
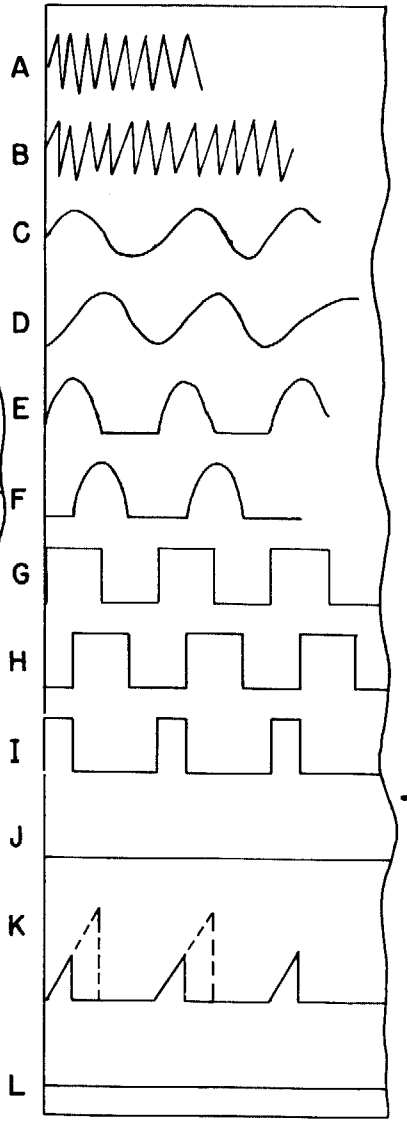
FIG. 6 illustrates, in graphical form, the wave shape patterns at different points in the system of FIG. 4.

FIG. 6 shows the wave shape of the signals at different points in the system of FIG. 4. A and B denote the signal received by $P_1$ and $P_2$ respectively. C and D show the signals after they have been preamplified and filtered to provide a narrow band-pass signal. E and F are the same signals after they have been amplified and half-wave rectified. The signals are then squared off (G and H) and the bistable switch associated with $P_1$ is turned on (I) while $P_2$'s bistable switch remains off (J). The signals are then integrated to provide control voltages (K and L) to the particular servos.

Figure 7:
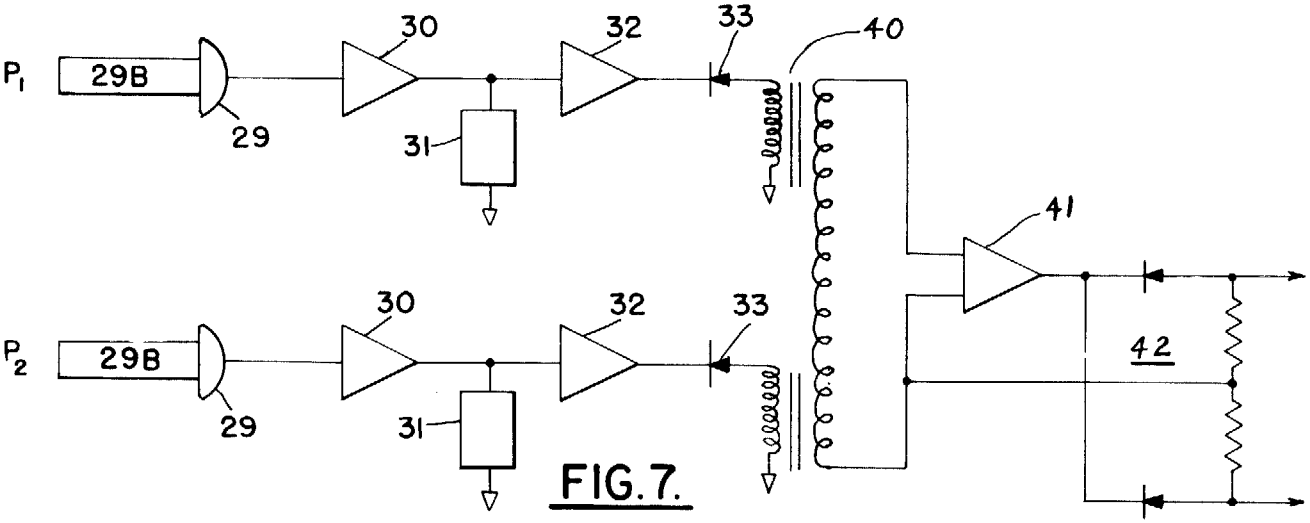
FIG. 7 illustrates, in block diagram form, another embodiment of the electrical guidance circuit employed in the inventive device.
Figure 8:
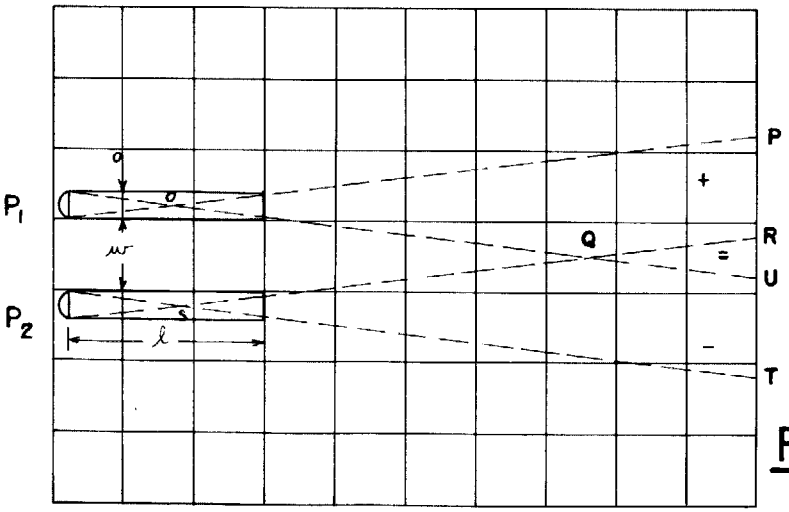
FIG. 8 illustrates the directionality of the electrical sound transducers employed with the circuit of FIG. 7.

An alternate concept is shown in FIG. 7 where the circuit electronics are amplitude dependent. The basic difference in this approach is the employment of a narrow listening window for the two transducer systems $P_1$ and $P_2$. Elements 29B are long hoods ($d/L < 10$) used to screen transducers 29. By making the ratio of the hood length to transducer diameter larger, the beam can be narrowed. In FIG. 8, the listening window for $P_1$ is contained in the area POU, for $P_2$ in the area RST, and both $P_1$ and $P_2$ monitor the area enclosed by RQU. If a target signal is located in the window of $P_1$ and not in that of $P_2$, there will be an unbalance in the received target signal amplitudes in the direction of $P_1$. The converse holds true for $P_2$. If the target signal is in the common window, that is $P_1$ and $P_2$, then there will not be an unbalance.

Referring again to FIG. 7, the components 29–33 are the same as described in the previous system (FIG. 4), and hence, need not be discussed again.

The transformer 40 has its windings connected to add and invert the rectified signal from 33. The output polarity of the transformer will be determined by the location of the target signal to the transducer system, and its amplitude by the degree of misalignment. The error signal is amplified by a signal amplifier 41 and rectified by a diode circuit 42 to provide a D.C. control signal to the steering yaw or pitch servo.

The means providing the control channels may be chosen so as to increase or decrease the sensitivity of the system to received sounds as desired. Only two electrical control channels have been shown since each pair connected to the pairs of sound transducers are similar in construction. Each pair of sound transducers employed on the vehicle would have individual control channels connected therewith.

Figure 9:
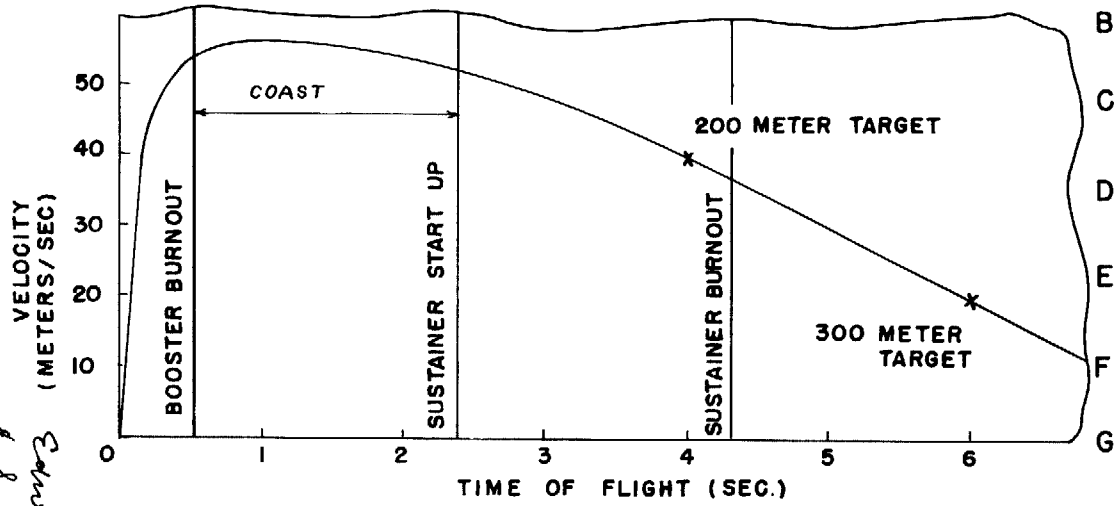
FIG. 9 illustrates, in graphical form, the trajectory followed by the inventive device when seeking out a target.

The propellant means 27 (FIG. 3), as said before, is preferably a two stage rocket motor. Referring to FIG. 9, it can be seen graphically that upon initiation of the motor, the boost stage launches the flight vehicle into its trajectory. A short burning boost time would be followed by a coast stage of about 2 seconds. At that time, a sustainer motor would be initiated for a burning time of approximately two seconds. This would maintain the vehicle velocity for optimum target seeking. There is no connection between thrust operation and target seeking. In case of premature burn-out or chuffing, the target would still be impacted provided there was enough initial velocity to home in with.

The normal flight path would cause the explosive charge to impact the target first. This will be very effective since target analysis reveals that the armor protection for the top of a vehicle is the minimum of all its profiles.

It will be further understood that various other changes may be made in the inventive device and the use thereof in accordance with the invention as herein described and shown. For example, the acoustic guidance means and circuits herein described and shown may be adapted to other types of aerial target seeking carriers.

We claim:

1. In a target-seeking flight vehicle having electrical signal-responsive flight-control means for guiding said vehicle vertically and laterally to intercept a target, a detection-guidance control system therefor attuned to sounds in a frequency range below one thousand cycles per second, said detection-guidance system comprising, a first and second pairs of spaced low-frequency sound-receiving electrical transducers carried by said vehicle for operation in vertically and laterally disposed relation in pairs and mounted and acoustically-shielded to receive sound waves from a target forward of said vehicle each over a limited angle, means providing a pair of electrical signal control channels connected from each pair of sound transducers and with said flight-control means, signal amplifier and rectifier circuits included in each of said channels and operative to produce directional-control output signals from each of said pairs of transducers dependent upon the received signal intensity thereon as determined by the location of a sound-emitting target with respect to said sound transducers and the angular limitations of the shielding thereon, said rectifier circuits being phase dependent and each including a diode connected to receive and rectify signals from a related one of said amplifier circuits, a clipper circuit connected to each of said rectifier circuits to clip the signal output therefrom, a normally-open switching circuit connected to receive the amplified and rectified output of each sound transducer following each clipper circuit and connected together in pairs related to said pairs of sound transducers, each of said switching circuits including a normally-open bistable switch and an AND gate connected therein to control and close said switch and thereby the switching circuit periodically in response to a clipped sound signal from one clipper circuit of a pair and not the other, the periodic ON time of said bistable switch being representative of the phase difference between the sound received by said transducers of a pair, thereby to pass clipped direction control output signals to said flight control means in response to received sound signals from one transducer of each pair and not the other, and signal integrator circuits connected with said switching circuits in pairs to produce said directional control signals from each pair of transducers for said flight-control means, thereby to maintain said vehicle on course to the target.

* * * * *